US007089707B2

(12) United States Patent
Uglietto et al.

(10) Patent No.: US 7,089,707 B2
(45) Date of Patent: Aug. 15, 2006

(54) RADIATOR WITH COVER AND MOUNTING BOARD AND METHOD OF INSTALLATION

(75) Inventors: Salvatore Uglietto, Winchester, MA (US); Gary Webster, Bicknacre (GB)

(73) Assignee: Vent Rite Valve Corporation, Randolph, MA (US)

( * ) Notice: Subject to any disclaimer, the term of this patent is extended or adjusted under 35 U.S.C. 154(b) by 0 days.

(21) Appl. No.: 11/077,520

(22) Filed: Mar. 10, 2005

(65) Prior Publication Data

US 2005/0193665 A1 Sep. 8, 2005

Related U.S. Application Data

(60) Division of application No. 10/026,865, filed on Dec. 21, 2001, now Pat. No. 6,889,911, which is a continuation-in-part of application No. 09/584,299, filed on May 31, 2000, now Pat. No. 6,550,688.

(60) Provisional application No. 60/338,954, filed on Dec. 10, 2001.

(51) Int. Cl.
*E04F 19/04* (2006.01)

(52) U.S. Cl. ..... 52/290; 52/718.01; 52/242

(58) Field of Classification Search ..... 52/290, 52/718.01, 718.04, 717.06, 220.1, 220.5, 52/718.05, 718.06, 242
See application file for complete search history.

(56) References Cited

U.S. PATENT DOCUMENTS

| | | | | |
|---|---|---|---|---|
| 1,004,252 | A | 9/1911 | Hall | |
| 2,132,400 | A * | 10/1938 | Curren | 174/72 C |
| 2,355,629 | A | 8/1944 | Carrier | |
| 2,983,215 | A | 5/1961 | Doolittle | |
| 3,091,289 | A | 5/1963 | Weinstein | |
| 3,263,746 | A | 8/1966 | Becher et al. | |
| 3,292,692 | A | 12/1966 | Person et al. | |
| 3,327,775 | A | 6/1967 | Owen | |
| 3,367,412 | A * | 2/1968 | Hagensick et al. | 165/56 |
| 3,384,168 | A | 5/1968 | Richter | |
| 3,447,597 | A | 6/1969 | McNabney | |
| 3,448,243 | A | 6/1969 | Ripple | |
| 3,448,795 | A | 6/1969 | McNabney | |
| 3,464,177 | A | 9/1969 | Amato | |
| 3,469,622 | A | 9/1969 | Yehle | |
| 3,470,352 | A | 9/1969 | McKay et al. | |
| 3,526,958 | A | 9/1970 | Grant | |
| 3,627,984 | A | 12/1971 | Bollinger et al. | |
| 3,721,762 | A * | 3/1973 | Gooding | 174/48 |
| 3,741,291 | A | 6/1973 | Limoni | |
| 3,780,797 | A | 12/1973 | Gebelius | |
| 3,786,171 | A * | 1/1974 | Shira | 174/48 |
| 3,795,274 | A | 3/1974 | Fieni | |
| 3,827,202 | A | 8/1974 | Phillips | |
| 3,858,995 | A * | 1/1975 | Sand | 403/300 |
| 3,867,981 | A | 2/1975 | Monroe | |
| 4,097,720 | A * | 6/1978 | Sand | 392/352 |
| 4,165,577 | A * | 8/1979 | Shanahan et al. | 43/112 |
| 4,273,990 | A | 6/1981 | Steiner et al. | |

(Continued)

FOREIGN PATENT DOCUMENTS

| | | |
|---|---|---|
| DE | 19908403 | 2/1998 |

(Continued)

*Primary Examiner*—Naoko Slack
(74) *Attorney, Agent, or Firm*—Choate Hall & Stewart LLP; Valarie B. Rosen

(57) ABSTRACT

A baseboard radiator having notched fins. The notches are retained by a flange on a back plate mounted to a wall. The fins are further retained by a flange in the upper portion of the back plate.

15 Claims, 13 Drawing Sheets

U.S. PATENT DOCUMENTS

| | | | | |
|---|---|---|---|---|
| 4,471,991 | A | 9/1984 | Matthias | |
| 4,689,470 | A | 8/1987 | Cunningham | |
| 4,714,194 | A | 12/1987 | Eckman | |
| 4,928,756 | A | 5/1990 | Shull et al. | |
| 5,274,972 | A * | 1/1994 | Hansen | 52/220.5 |
| 5,406,937 | A | 4/1995 | Uglietto et al. | |
| 5,597,033 | A | 1/1997 | Cali | |
| 5,651,224 | A | 7/1997 | Brabant | |
| 5,884,690 | A | 3/1999 | Zussman et al. | |
| 5,950,720 | A | 9/1999 | Klix | |
| 6,382,307 | B1 | 5/2002 | Wang et al. | |
| 6,513,289 | B1 * | 2/2003 | Decore et al. | 52/288.1 |

FOREIGN PATENT DOCUMENTS

| | | |
|---|---|---|
| GB | 1004252 | 9/1965 |
| GB | 2215027 | 9/1989 |

* cited by examiner

RADIATOR WITH COVER AND MOUNTING BOARD AND METHOD OF INSTALLATION

This application claims priority as a divisional from U.S. application Ser. No. 10/026,865, filed Dec. 21, 2001 now U.S. Pat. No. 6,889,911, which is a continuation in part of U.S. application Ser. No. 09/584,299, filed May 31, 2000 now U.S. Pat. No. 6,550,688, and which also claims priority from U.S. Provisional Application No. 60/338,954, filed Dec. 10, 2001 the entire contents of all of which are incorporated by reference herein.

FIELD OF THE INVENTION

This invention pertains to a baseboard radiator system, and, more particularly, to a baseboard radiator system characterized by easy mounting and cleaning.

BACKGROUND OF THE INVENTION

Baseboard radiators, such as described in U.S. Pat. No. 5,406,937, the contents of which are incorporated herein by reference, are mounted on a wall. U.S. Pat. No. 5,597,033, incorporated herein by reference, notes the desire for easier installation of baseboard heaters, and the desire for attractive coordinating covers. U.S. Pat. No. 4,689,470 notes that present baseboard heaters are relatively complicated to install.

Baseboard heaters can be heavy and bulky. Flow of fluid in the pipes can be affected by improper leveling of the radiator during installation, and the radiator must be mounted above floor level for proper air circulation.

Among the considerations for installation is the need for an air space. For example, an article on Hydronic Baseboard Basics by John Siegenthaler, P.E. states, "When baseboard is installed before finish flooring, remember to leave at least a 1 inch space beneath the enclosure. This ensures that the finished floor will not block air coming into the enclosure." Also to prevent noise, it suggests using hangers that flex as the pipe expands and which are coated for handing copper tubing.

SUMMARY OF THE INVENTION

The invention is a mounting system for a baseboard radiator. The radiator includes a back plate having a rear portion, a lower flange disposed at a first predetermined angle with the rear portion, a top portion disposed at a second predetermined angle with the rear portion, and a front flange disposed at a third predetermined angle with the top portion, wherein the back plate is adapted and constructed to retain a core assembly having a rear groove in an underside of the core. This system may further comprise a starter plate having an elongated flat plate and a first flange extending for the length of the starter plate and forming an angle approximately equal to 180° less the size of the first predetermined angle. When the starter plate is mounted on a wall, the first flange and the wall define a groove that is adapted and constructed to receive a wedge defined by the lower flange and the rear portion. This starter plate may further include a second flange that extends along the length of the starter plate. The angle described by the second flange and the flat plate may be the same or different as the angle defined by the first flange and the flat plate. The mounting system may further include a cover having a front face, a pivot flange disposed along a bottom edge of the front face that engages a front groove in an underside of the core, an angled face disposed at an upper edge of the front face, an upper face adjacent to the angled face that is parallel to the top portion of the back plate when the cover is installed, and a fixing flange disposed at the second predetermined angle with the upper face that fits between the rear portion and the wall. The angled face may include a plurality of apertures having at least one pre-selected shape.

In another aspect, the invention is a radiating fin. The fin includes a lower edge comprising a rear notch for engaging a mounting system. The fin may also include a connecting edge extending between a front edge and the a top edge of the fin, wherein at least a portion of the connecting edge is neither parallel to the front edge nor perpendicular to the top edge. Alternatively or additionally, the fin may include a front flange extending from at least a portion of the front edge of the fin, a rear flange extending from at least a portion of a rear edge of the fin, and a top flange extending from at least a portion of the top edge of the fin. Additionally or alternatively, the fin may further include a plurality of round apertures each comprising a circumferential flange. The top edge may be shorter than the lower edge.

BRIEF DESCRIPTION OF THE DRAWING

The invention is described with reference to the several figures of the drawing, in which, FIGS. 1A and B depict exemplary fins for an embodiment of the invention.

DETAILED DESCRIPTION

Figure 1B:
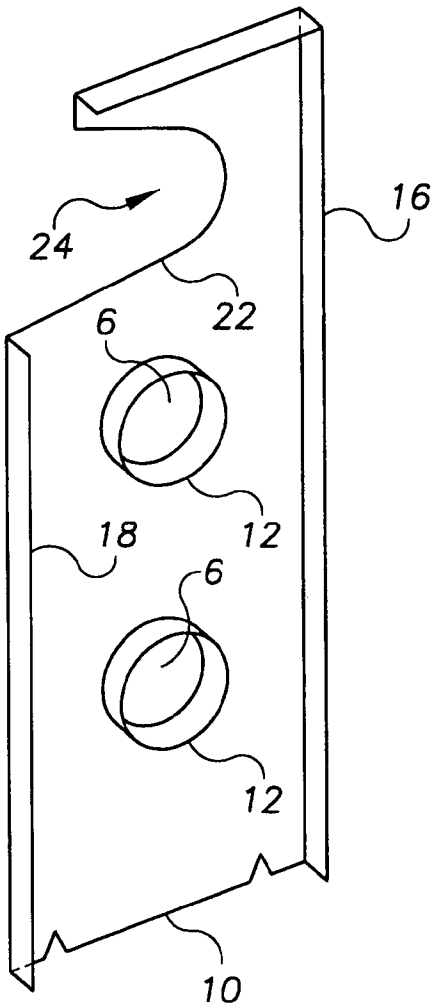
Figure 1A:
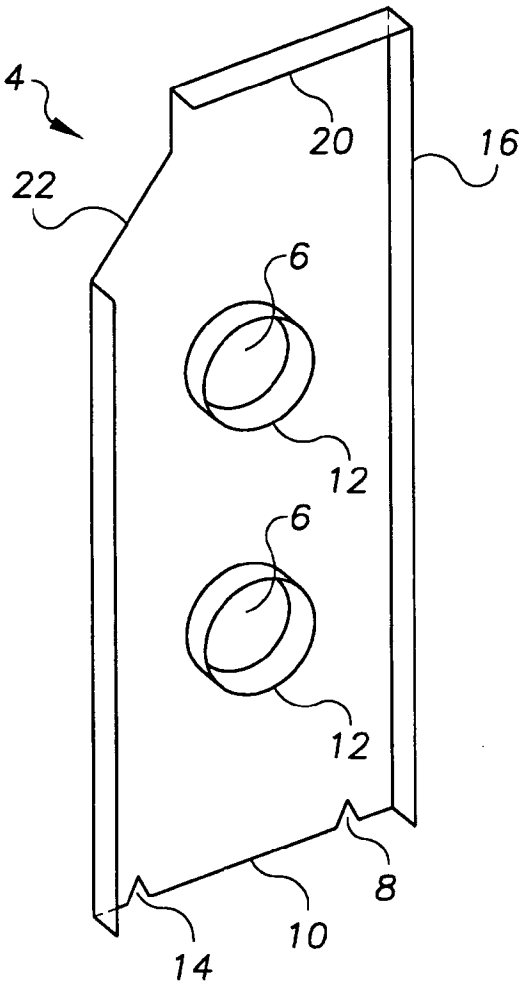
Figure 2A:
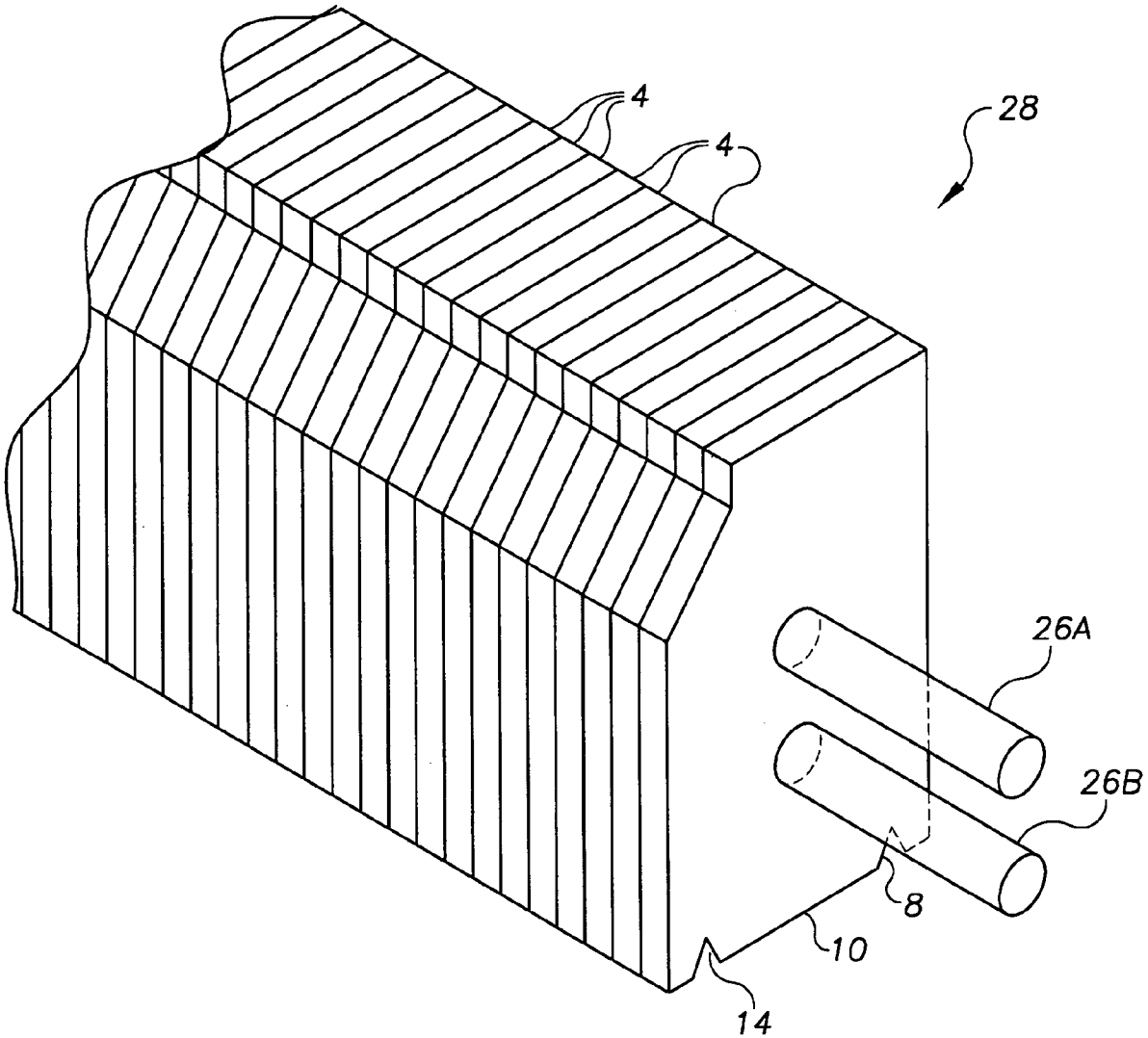
FIG. 2A depicts a core unit according to an embodiment of the invention, showing the fins but omitting the grooves for clarity.
Figure 2B:
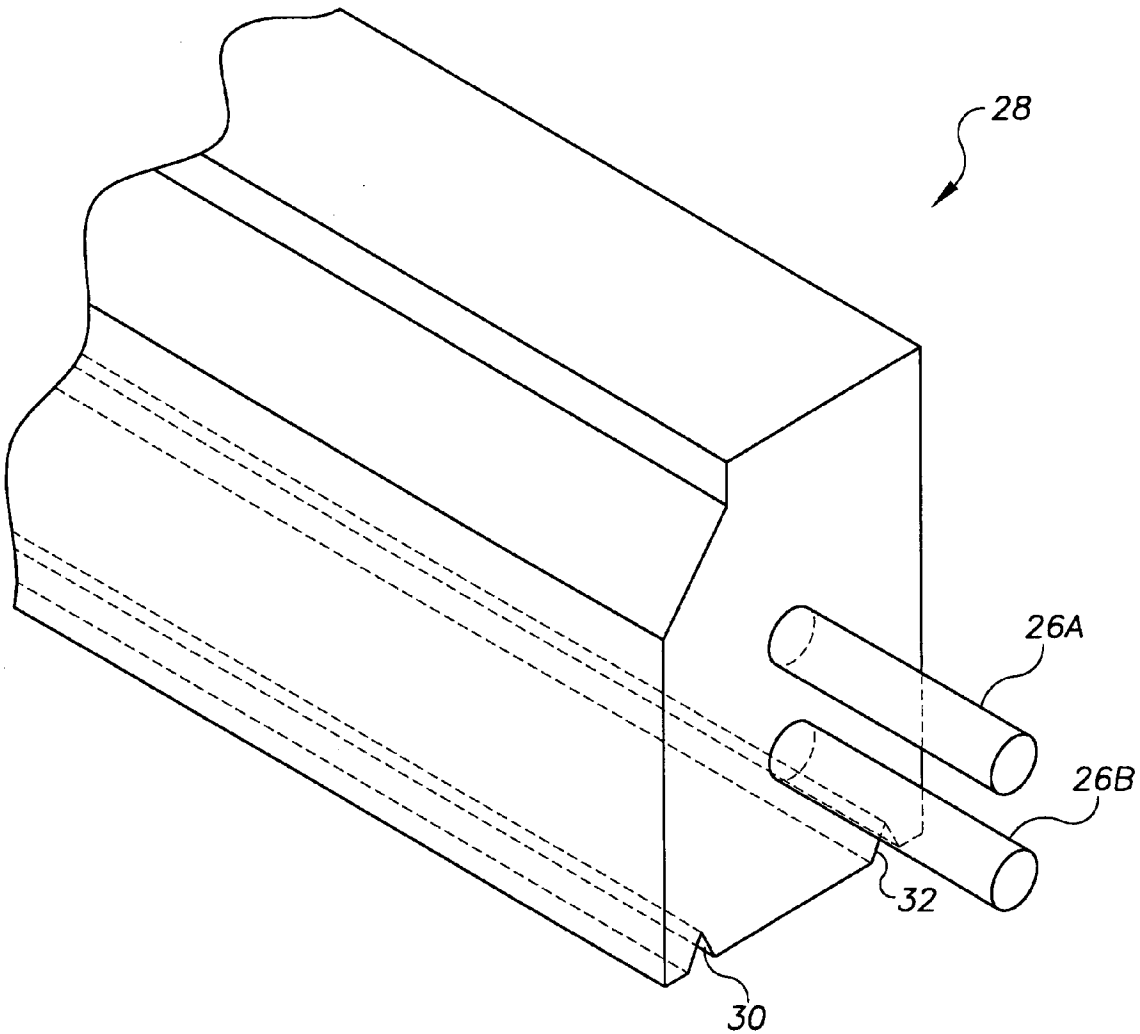
FIG. 2B depicts a core for a radiator according to an embodiment of the invention, showing front and rear grooves in the underside of the core but omitting the fins themselves for clarity.

For ease of mounting, the fins 4 of a radiator having pipes passing through one or more apertures 6 have been provided with a rear notch 8 on lower edge 10 (FIG. 1). Apertures 6 may be defined by a surrounding lip 12 for reinforcement. A front notch 14 is also disposed on lower edge 10 of fin 4. As shown in FIG. 1A, the fins 4 have a rear flange 16, a front flange 18, and a top flange 20. Top flange 20 should be shorter than the distance between rear flange 16 and front flange 18, resulting in a diagonal 22 between the front flange 18 and top flange 20. The shape of the fins need not define a straight line between front flange 18 and top flange 20. For example, there may be an elongated notch 24 between front flange 18 and top flange 20, as shown in FIG. 1B, resulting in a beak-like profile. The diagonal 22 between the front flange 18 and top flange 20 facilitates air circulation from the radiator to the room. In a preferred embodiment, a plurality of fins 4 are stacked horizontally with pipes 26A and B extending through the tunnel created by apertures 6 to form core 28 (FIG. 2A). The aligned front notches 14 and rear notches 8 line up to form front groove 30 and rear groove 32 in core 28 (FIG. 2B).

The fins may adopt a variety of shapes. They are generally taller than they are wide but may be square. In addition, the diagonal 22 may be omitted, and all four sides of the fin may meet at right angles. While a roughly rectangular fin 4 with two apertures 6 is depicted in FIG. 1, in an alternative embodiment, fins 4 are larger in area and can accommodate more pipes 26. The popes need not define separate paths for heated water supplied by a boiler. Instead, a single pope may be bent in to a "U" at the end of core 28 and passed through the fins 4 a second time, recirculating hot water through the radiator instead of sending the still-hot water back to the boiler. Depending on the shape and size of the fin, a plurality of pipes may be circulated one, two, or more times through the core. Larger fins would of course require more apertures 6 to accommodate the pipes.

Figure 3:
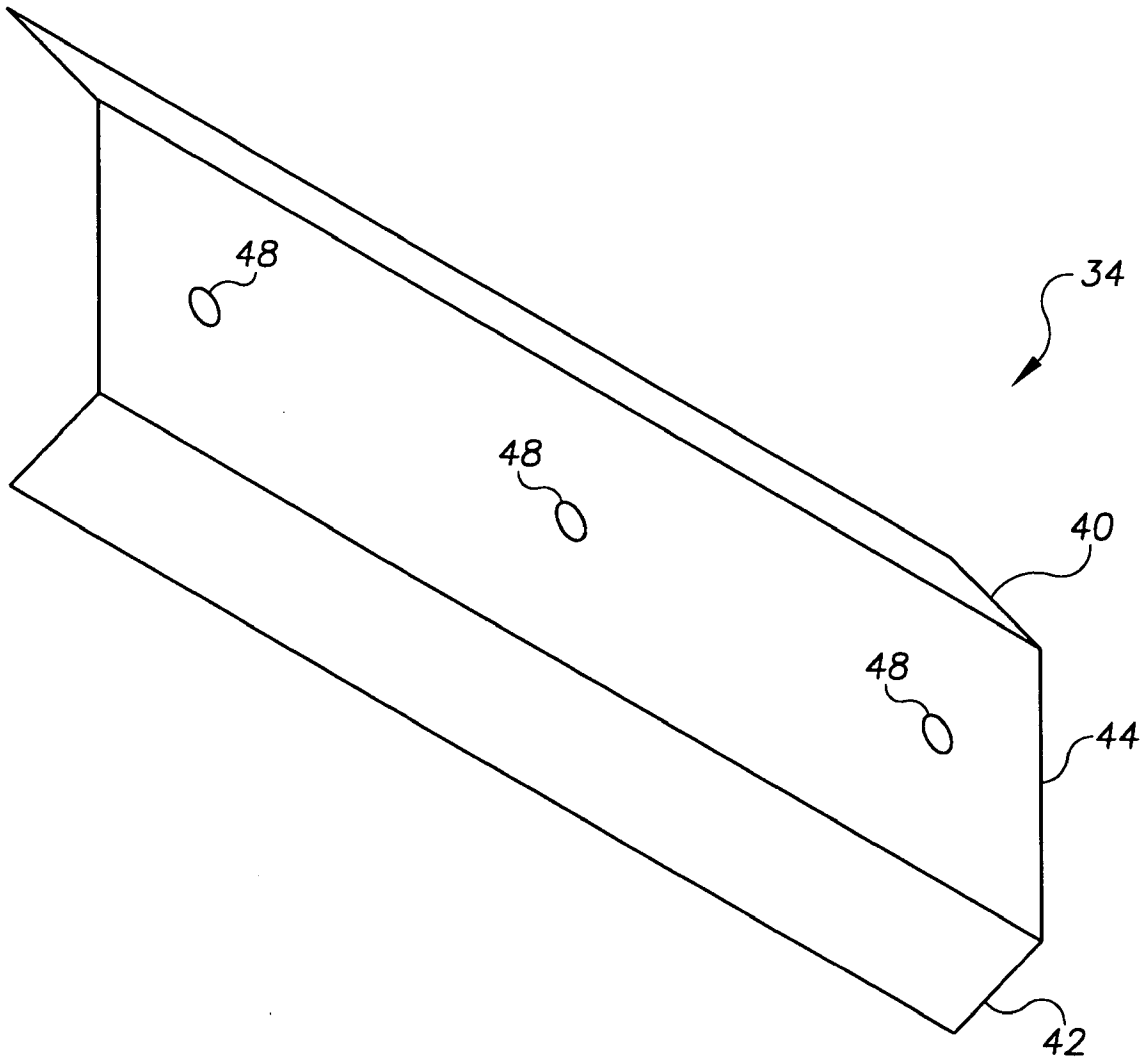
FIG. 3 depicts a starter strip for use with an embodiment of the invention.
Figure 5:
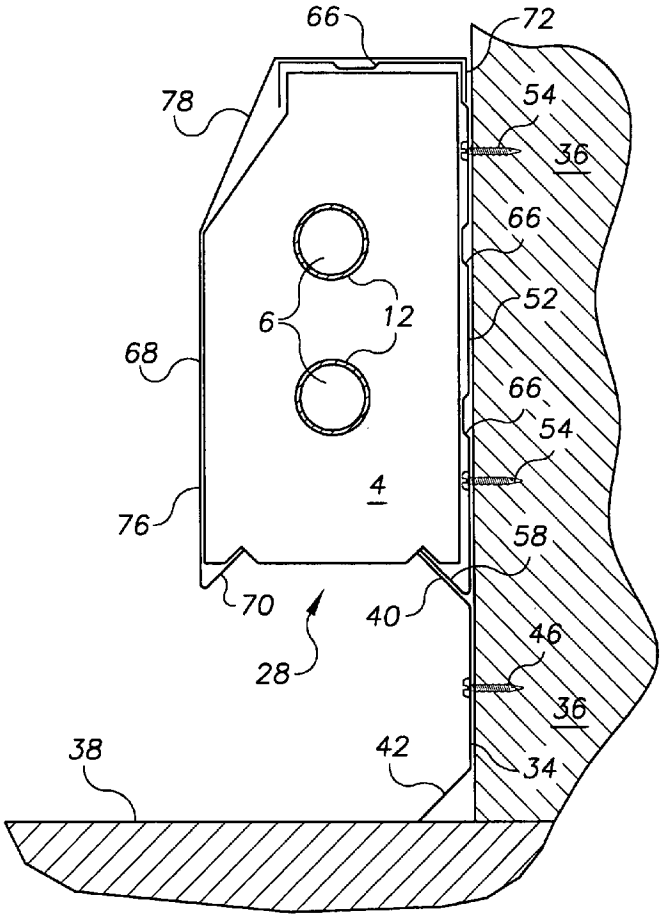
FIG. 5 depicts a side view of a radiator mounted according to an embodiment of the invention.

To mount the radiator core 28, a starter strip 34 may be mounted on wall 36 near floor 38 (FIGS. 3 and 5). In one embodiment, starter strip 34 is formed from aluminum, which is lightweight and rapidly conducts heat. At least one of flanges 40 and 42 preferably makes an angle of about 135° with flat plate 44. This provides an even distribution of force against wall 36 and floor 38. The angles of flanges 40 and 42 need not be the same, but a symmetrical starter strip will ease installation. If the starter strip is symmetric, then a flat plate 44 with a height of one inch will result in an overall height of about 1.75 inches. Alternatively, the angles of flanges 40 and 42 may be adjusted, or the width of the flanges or flat plate 44 may be adjusted so the starter strip 34 is taller than 1.75 inches. Starter strip 34 may be omitted if the core 28 is to be mounted higher along the wall 36. Preferably, the core is mounted at least 1.75 inches from the floor. Even more preferably, the core is mounted 2 to 3 inches from the floor. Starter strip 34 may be mounted to wall 36 with screws 46 via holes 48.

Figure 4:
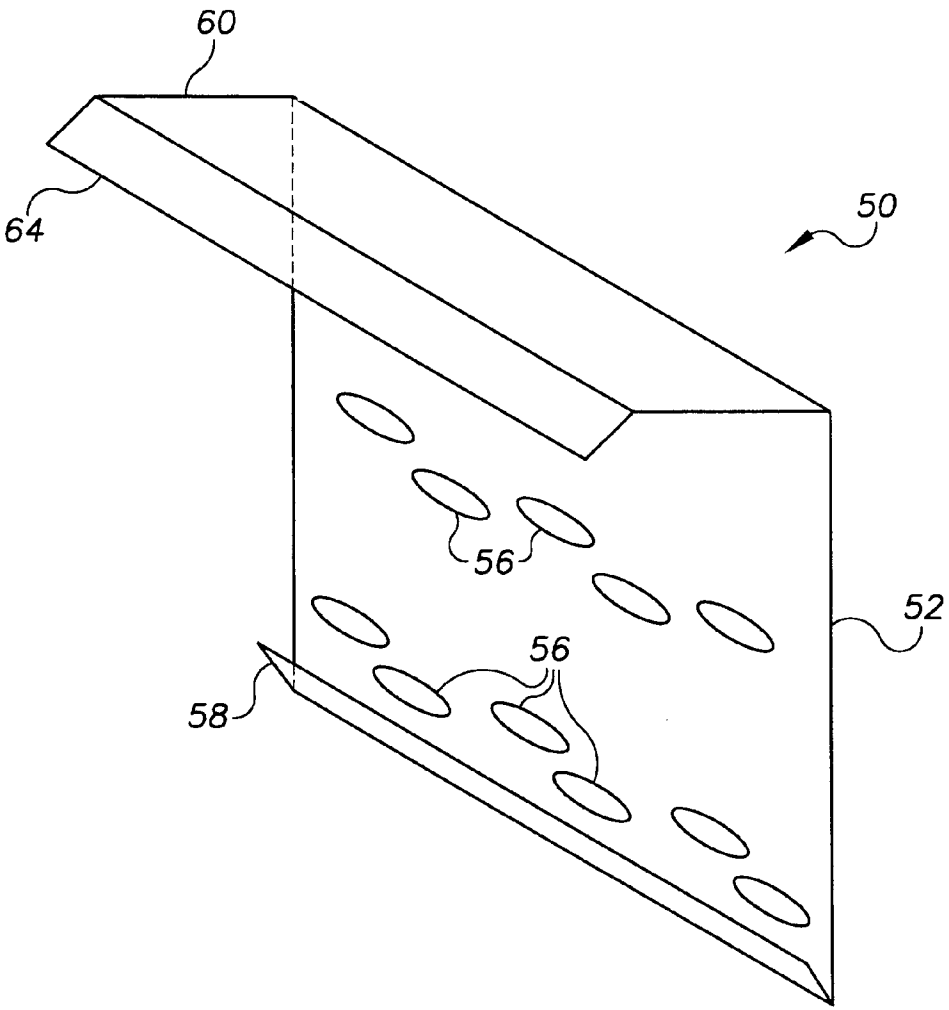
FIG. 4 depicts a back plate for use with the invention.

Once the starter strip is in place, back plate 50 is mounted via its rear portion 52 (FIG. 4). Screws 54 are used to attach back plate 50 to wall 36 through slots 56 (FIG. 5). Preferably, a plurality of horizontal slots are provided on the rear portion 52 of back plate 50 so that the back plate may be attached to several studs regardless of the disposition of the back plate 50 with respect to the walls of the room. Two doubled rows of staggered slots 56 provide essentially continuous access to wall 36 without reducing the stiffness of back plate 50. The height of back plate 50 from the floor 38 is set by coordination of support flange 58 with the groove defined by the uppermost of the flanges 40 and 42 of starter strip 34 with wall 36. The angle defined by support flange 58 with rear portion 52 and the angle between the upper most of flanges 40 and 42 with wall 36 should be approximately the same. In one embodiment, the angle is approximately 45°. The back plate 50 should not be merely supported by starter strip 34 but should be leveled and mounted to wall through slots 56. Back plate 50 also has a top 60 and a retaining flange 64. The angle between top 60 and retaining flange 64 should conform to the shape of the upper portion of fins 4. In one embodiment, the angle is 90°. Indentations 66 in back plate 50 provide air space between back plate 50 and core 28, reducing accumulation of moisture and subsequent corrosion (FIG. 5). The top indentations 66 accommodate flanges 72 on cover 68.

Figure 6:
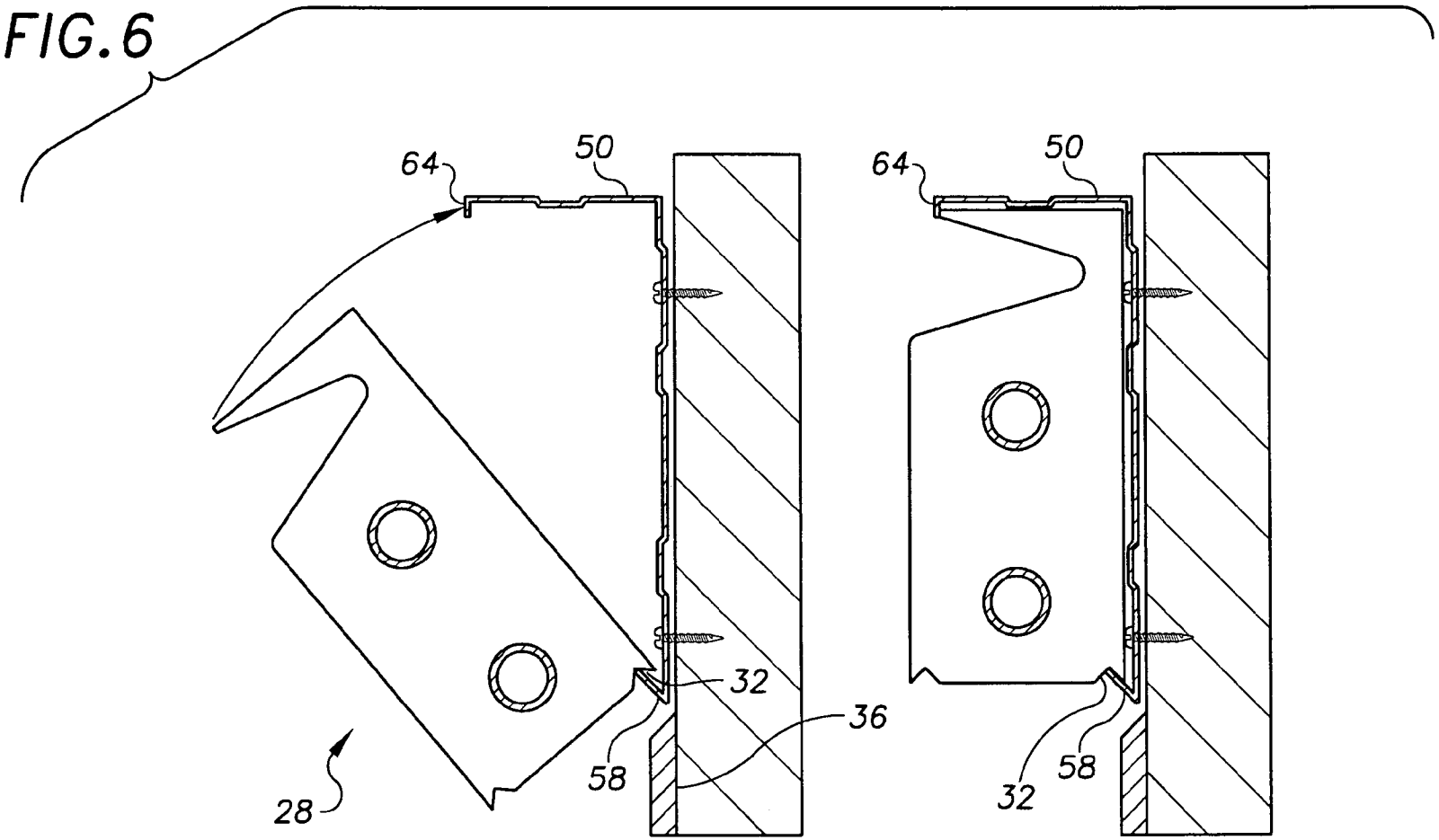
FIG. 6 depicts installation of an exemplary core according to an embodiment of the invention.

After back plate 50 is mounted and leveled, core 28 is easily fitted into place by matching rear groove 32 with support flange 58 and snapping the upper portion of the core 28 in place under retaining flange 64 (FIG. 6). This method eases installation, more firmly secures the radiator to the wall, and insures that the radiator remains level during installation. Once the core 28 is in place, pipes 26 may be connected to a boiler or other source of circulating hot water. The use of two pipes 26A and 26B increases the efficiency of the radiator unit by extracting as much heat as possible from the hot water. Heat is extracted from the water returning to the boiler, as well as newly-heated water coming from the boiler. If a larger fin 4 is used with the system, it may include more than two apertures 6 to accommodate more pipes and reduce the distance for heat transfer in the fin. Because the core 28 is retained only by support flange 58 and retaining flange 64, it is able to accommodate thermal expansion and contraction without placing additional stress on fixed points of attachment. This will reduce noise generated by fixed components as the system heats up.

Figure 7:
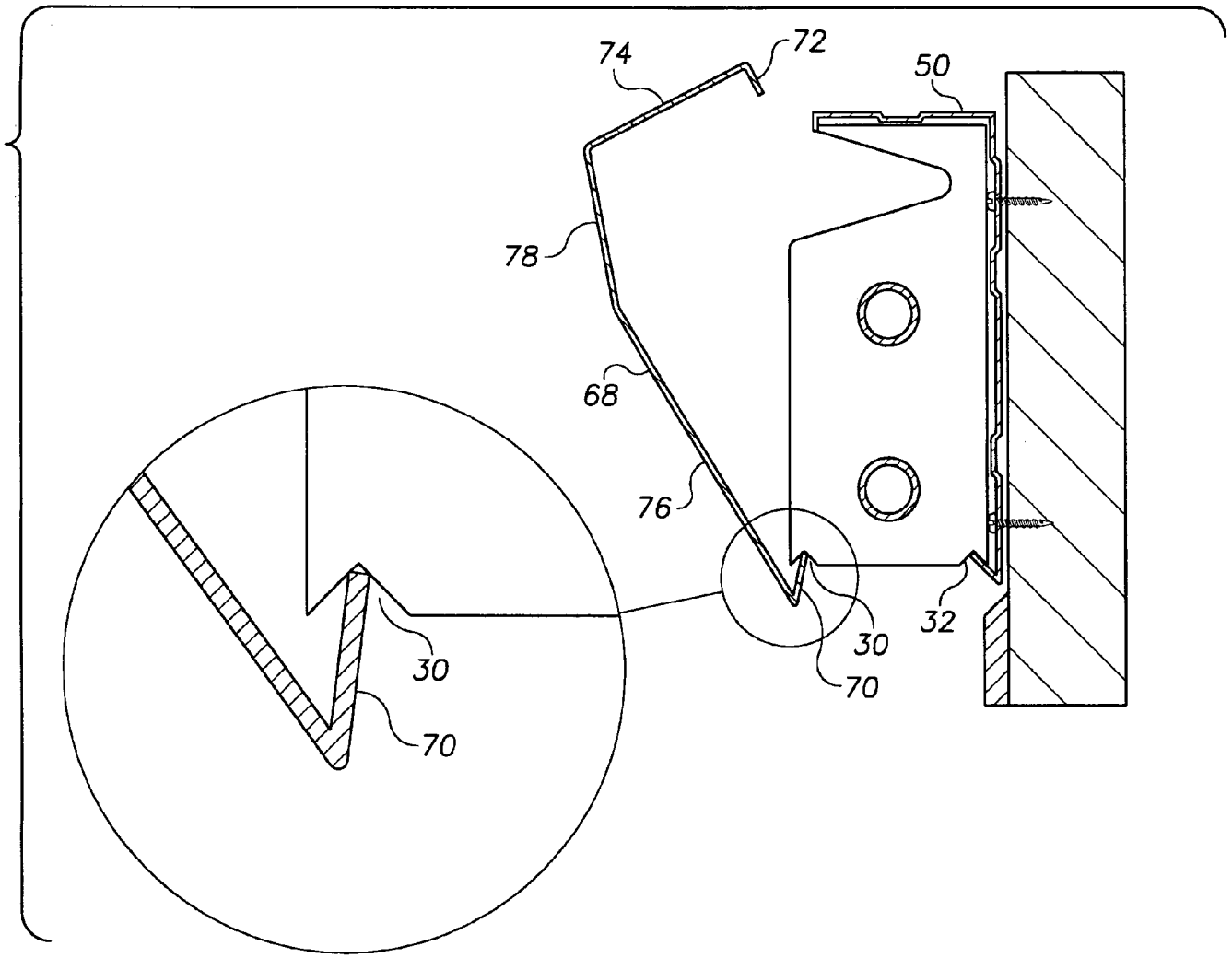
FIG. 7 depicts installation of a cover for a radiator according to an embodiment of the invention.
Figure 8:
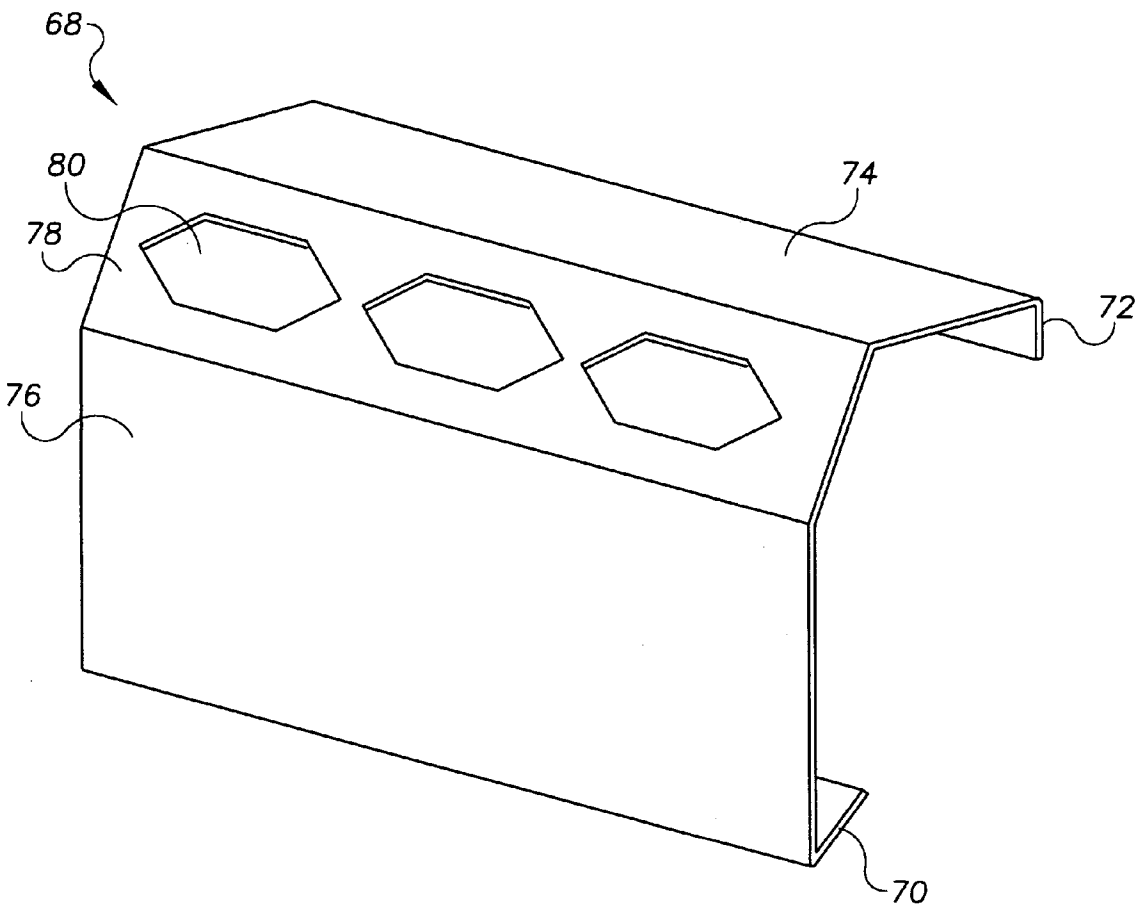
FIG. 8 depicts an exemplary cover for use with the invention.
Figure 9:
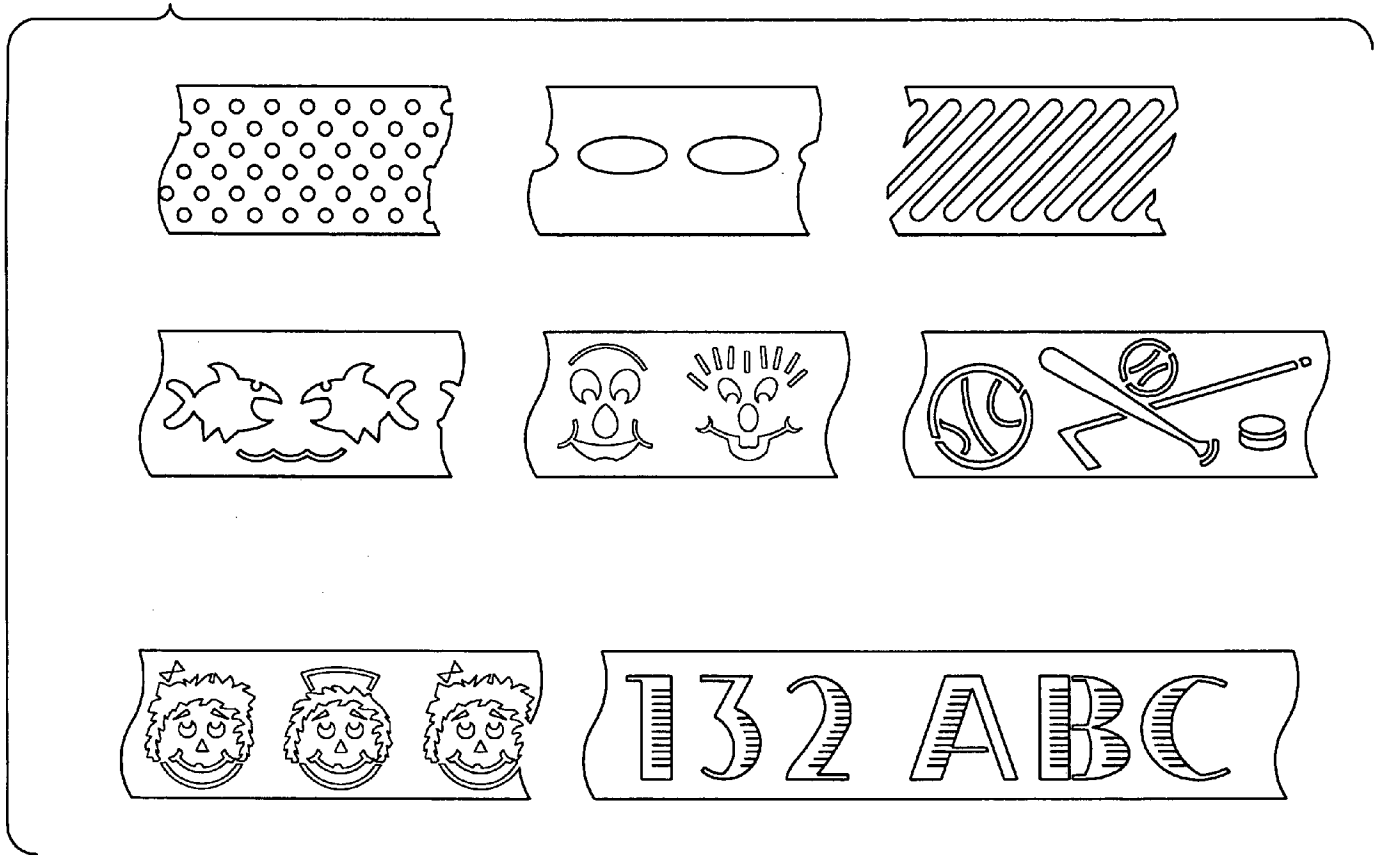
FIG. 9 depicts a variety of hole patterns for use in the cover.

Once the core 28 is in place, cover 68 is installed (FIG. 7). Pivot flange 70 is fitted into front groove 30 and fixing flange 72 is snapped in place behind rear portion 52 of back plate 50 and into top indentation 66 of back plate 50. Cover 68 has an upper portion 74 that extends generally parallel to top 60 of backplate 50. The cover should conform to the general shape of fins 4. For example, the front flange 18 of fins 4 may extend further from rear flange 16 of fins 4 than the length of top flange 20. Consequently, cover 68 would have front panel 76 and an angled panel 78 as shown in FIG. 8. If there is a notch 24 between the front flange 18 and top flange 20 of fins 4 (FIG. 1B), angled panel 78 should merely run between the front flange 18 and top flange 20 without conforming to the notch 24. Angled portion 78 should also contain a plurality of holes 80 to allow the circulation of hot air from within the radiator core into the room. A variety of methods of forming such holes are well known to those skilled in the art, and holes 80 may have practically any shape or pattern. For example, the holes may form one or more rows of circles, ellipses, ovals, elongated octagons, or various polygons. Alternatively, holes 80 may define a staggered or unstaggered pattern of circles, triangles, squares, diamonds, or other shapes. For example, a set of diagonal slots may be cut into angled portion 78. It is not necessary to use merely geometric shapes. Fanciful shapes such as flowers, animals, words, toys, or sports equipment may also be cut into the cover. A variety of exemplary patterns is depicted in FIG. 9. Because the cover is easily replaced, it is possible to place a cover having cutouts in the shape of cartoon characters or Muppets™ in a small child's bedroom. As the child grows older, the cover may be replaced with cutouts that are more age appropriate, such as sports equipment or rainbows.

The starter strip 34, back plate 50, cover 68, and other external parts of the radiator may be coated using electrostatic powder coating. Such a coating provides an attractive, slick, and heat and corrosion resistant finish, and can be any desired color. In one embodiment, the thickness of the material for the starter strip, back plate, and cover is about one millimeter and the depth of the support flange 58 and pivot flange 70 are both about 0.5 inches, although other thicknesses and depths are possible.

Figure 10A:
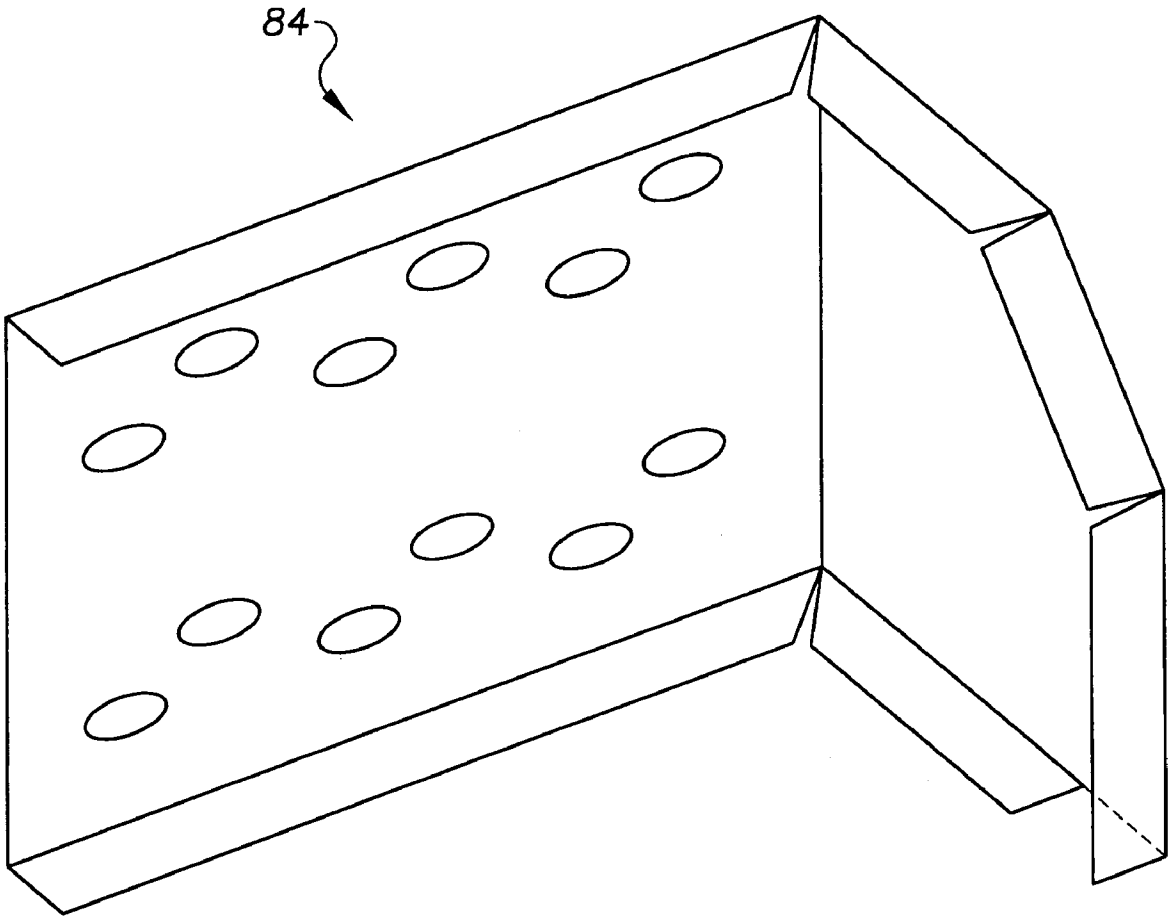
FIG. 10A depicts an end cap back portion for use with the invention.
Figure 10B:
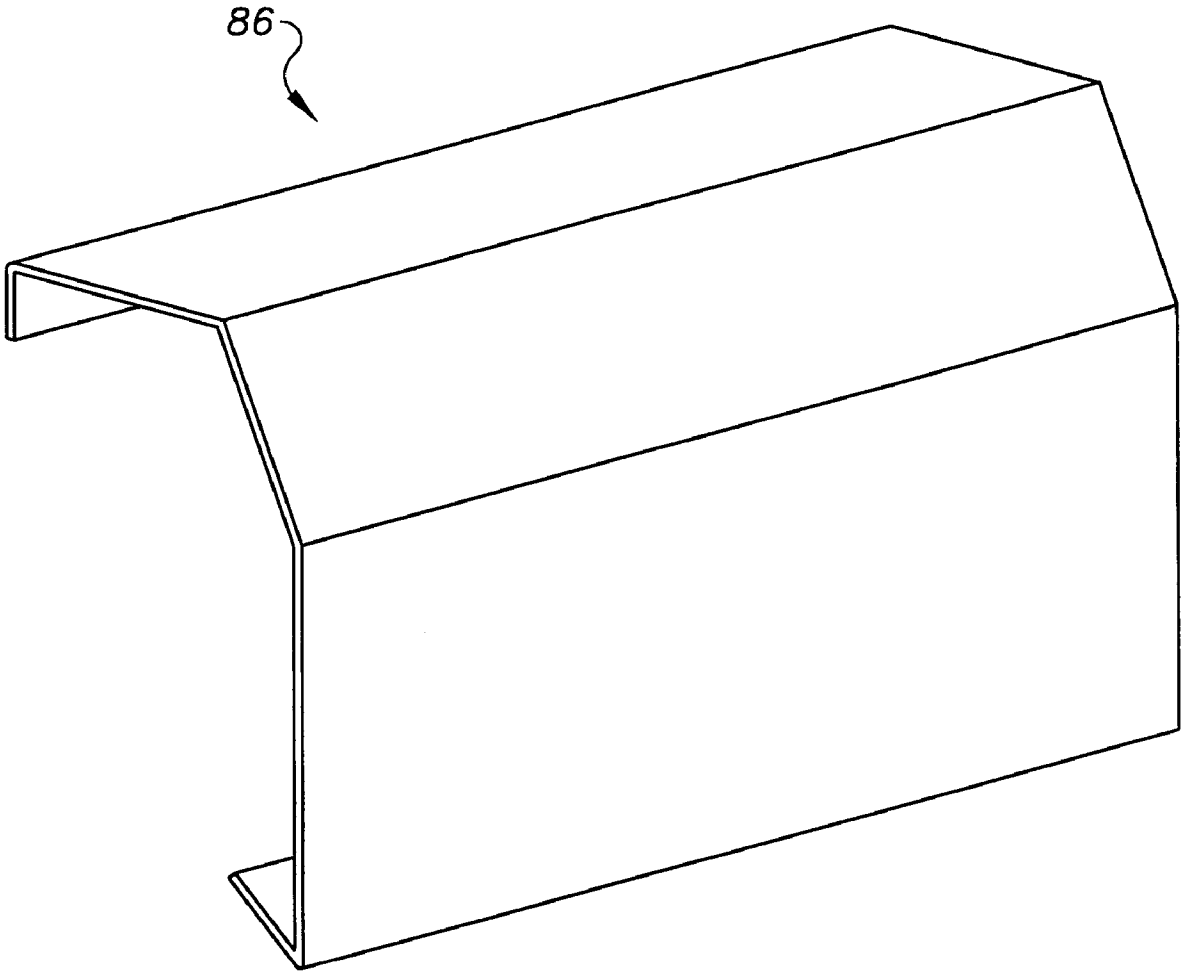
FIG. 10B depicts an end cap cover for use with the invention.
Figure 11:
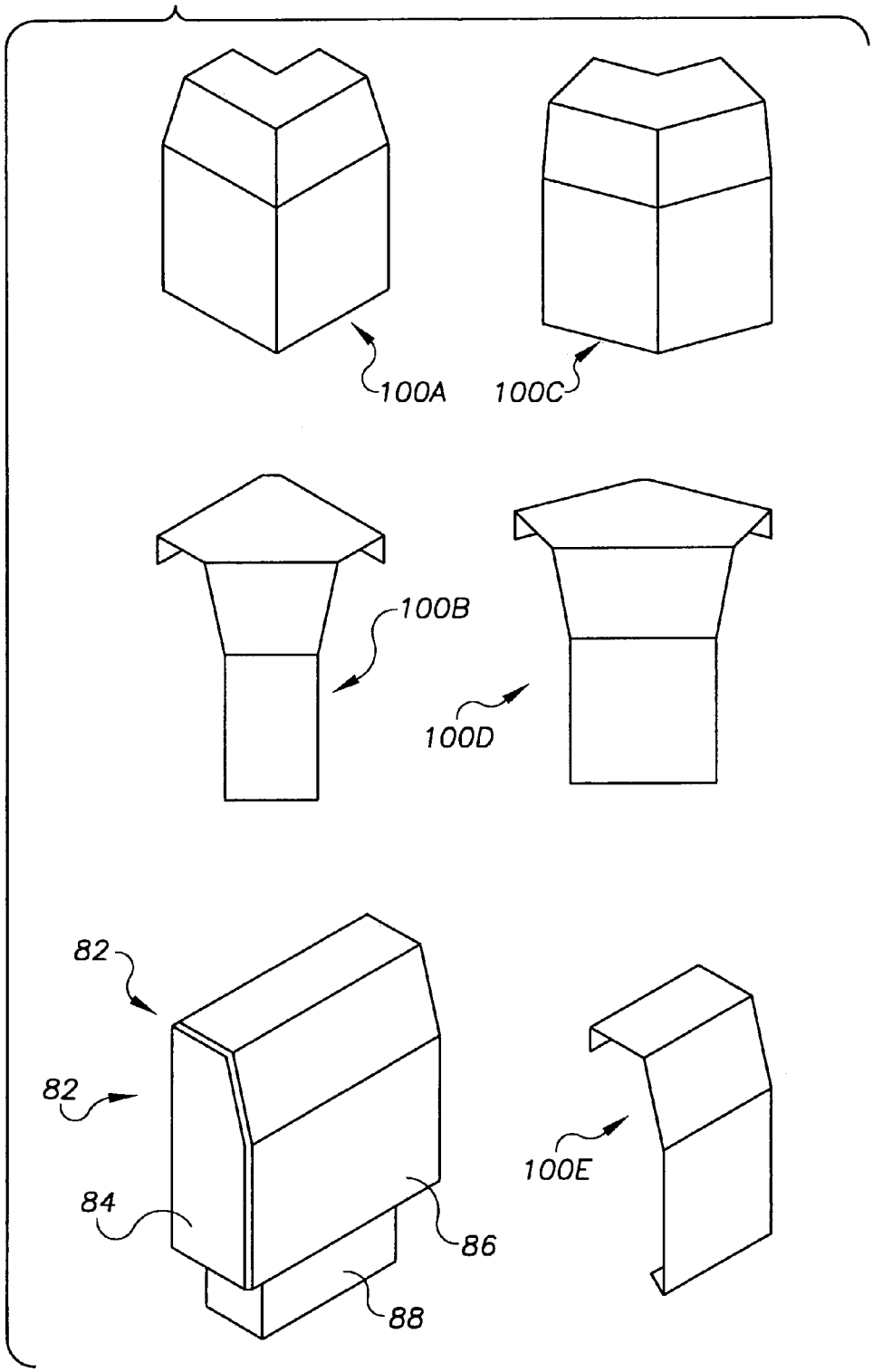
FIG. 11 depicts various hardware that may be used to hide junctions, spaces, and pipes in a mounted radiator.

An end cap 82 may be placed at the end of the radiator to provide a more aesthetic covering for the pipes 26 (FIG. 11). In one embodiment, the end cap 82 includes a back portion 84 that is mounted on wall 36 at the end of and butted up to back plate 50 (FIG. 10A). End cap 82 may be right or left handed depending on which side of the radiator it is mounted on and may be of any length. End cap cover 86 is then snapped into place over the back portion 84 (FIG. 10B). In a preferred embodiment, end cap cover 86 should have a shape similar to that of cover 68 to provide uniformity and should be at least 1 inch larger than end cap back portion 84. In addition, a pipe cover 88 may be affixed to end cap cover 86 to hide pipes 26 if they are directed into the floor at the end of the radiator. If two more radiator units are installed adjacent to one another, various splicers or corners may be used to cover the gap between radiator units (FIG. 11). The profile of the splicer or corner should be similar to that of cover 68. In addition, a splicer should have a pivot flange similar to pivot flange 70 of cover 68 for more secure fixation. FIG. 11 shows a number of corners and spacers, including 90° outside corner 100A, 90° inside corner 100B, 135° outside corner 100C, 135° inside corner 100D, and splicer 100E. Splicer 100E may be produced in a variety of lengths for use with different gap sizes. End cap cover 86 and the corners and spacers shown in FIG. 11 do not need holes similar to holes 80 to provide air circulation but may have similar holes for decorative purposes.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. A mounting system for a baseboard radiator, comprising a back plate, the back plate comprising:

a rear portion;

a lower flange disposed at a first predetermined acute angle with the rear portion, the lower flange and the rear portion defining a wedge having an edge, the edge defining a lower edge of the rear portion;

a top portion disposed at a second predetermined angle with the rear portion; and a front flange disposed at a third predetermined angle with the top portion, wherein the back plate is adapted and constructed to retain a core assembly having a rear groove in an underside of the core.

2. The mounting system of claim 1, further comprising a starter plate, the starter plate being separate from the back plate comprising:

an elongated flat plate; and a first flange extending for the length of the starter plate and forming a fourth predetermined angle with the elongated flat plate, wherein the size of the fourth predetermined angle is approximately equal to 180° less the size of the first predetermined angle, and when the starter plate is mounted on a wall, the first flange and the wall define a groove that is adapted and constructed to receive the wedge .

3. The mounting system of claim 2, wherein the starter plate further comprises a second flange that extends along the length of the starter plate and defines a fifth predetermined angle with the flat plate.

4. The mounting system of claim 3, wherein the fifth predetermined angle is approximately the same size as a fourth predetermined angle.

5. The mounting system of claim 1, wherein the second predetermined angle is approximately 90°.

6. The mounting system of claim 1, wherein the third predetermined angle is approximately 90°.

7. The mounting system of claim 1, wherein the back plate further comprises a plurality of staggered horizontal slots that are adapted and constructed to permit attachment of the back plate to a wall at a predetermined plurality of points on the wall.

8. The mounting system of claim 1, further comprising a cover, the cover comprising:

a front face;

a pivot flange disposed along a bottom edge of a front face that, when the cover is installed, engages a front groove in an underside of the core;

an angled face disposed at an upper edge of the front face;

an upper face adjacent to the angled face that, when the cover is installed, is parallel to the top portion of the back plate; and a fixing flange disposed at the second predetermined angle with the upper face that, when the cover is installed, is disposed between the rear portion and a wall on which the backplate is mounted.

9. The mounting system of claim 8, wherein the angled face comprises a plurality of apertures having at least one preselected shape.

10. The mounting system of claim 1, further comprising a cover, the cover comprising a back section, a top section, said top section being oriented perpendicularly to said back section, a front section, and an engaging edge located at the lower edge of said front section wherein, when the cover is installed, the back section is disposed between the rear portion and a wall to which the back plate is mounted, and the top and front sections are disposed about the top portion and front flange of the back plate.

11. The mounting system of claim 10, wherein the cover is fabricated from coated aluminum.

12. The mounting system of claim 10, wherein the front section further includes a bottom front section having said lower edge, wherein the top front section is oriented at an obtuse angle to the top section and wherein the top front section and the bottom front section are not coplanar.

13. A mounting system for a baseboard radiator, comprising a back plate, the back plate comprising:

a rear portion;

a lower flange disposed at a first predetermined angle with the rear portion;

a top portion disposed at a second predetermined angle with the rear portion; and a front flange disposed at a third predetermined angle with the top portion, wherein the back plate is adapted and constructed to retain a core assembly having a rear groove in an underside of the core, wherein the first predetermined angle is about 45°.

14. A mounting system for a baseboard radiator, comprising a back plate, the back plate comprising:

a rear portion;

a lower flange disposed at a first predetermined angle with the rear portion;

a top portion disposed at a second predetermined angle with the rear portion; and a front flange disposed at a third predetermined angle with the top portion, wherein the back plate is adapted and constructed to retain a core assembly having a rear groove in an underside of the core, wherein the backplate further comprises a plurality of raised indentations disposed in one or both of the rear portion and the top portion, wherein the indentations are directed towards the side of the rear portion from which the top portion projects.

15. A mounting system for a baseboard radiator, a back plate, the back plate comprising:

a rear portion;

a lower flange disposed at a first predetermined angle with the rear portion;

a top portion disposed at a second predetermined angle with the rear portion; and a front flange disposed at a third predetermined angle with the top portion, wherein the back plate is adapted and constructed to retain a core assembly having a rear groove in an underside of the core, wherein the front section includes a top front section having multiple apertures.

* * * * *